US007785234B2

(12) United States Patent
Nakanishi

(10) Patent No.: US 7,785,234 B2
(45) Date of Patent: Aug. 31, 2010

(54) ROCKING TYPE EXERCISING APPARATUS

(75) Inventor: Ryusuke Nakanishi, Nagoya (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/232,119

(22) Filed: Sep. 11, 2008

(65) Prior Publication Data

US 2009/0075783 A1 Mar. 19, 2009

(30) Foreign Application Priority Data

Sep. 13, 2007 (JP) ..... 2007-238342

(51) Int. Cl.
*A63B 22/00* (2006.01)
*A63B 69/00* (2006.01)
*A63G 13/06* (2006.01)

(52) U.S. Cl. ..... 482/51; 472/95; 434/247

(58) Field of Classification Search ..... 482/51, 482/148, 95; 434/247, 62, 64–65; 472/95–97, 472/27, 29, 102–103
See application file for complete search history.

(56) References Cited

U.S. PATENT DOCUMENTS

| | | | | |
|---|---|---|---|---|
| 4,988,300 | A | 1/1991 | Yamaguchi et al. | |
| 5,085,425 | A * | 2/1992 | Collins et al. | 472/97 |
| 6,488,640 | B2 * | 12/2002 | Hood et al. | 601/23 |
| 6,666,802 | B1 * | 12/2003 | Rasmussen | 482/148 |
| 7,070,415 | B2 * | 7/2006 | Hojo et al. | 434/247 |
| 7,338,412 | B2 * | 3/2008 | Nakanishi | 482/51 |
| 7,338,413 | B2 * | 3/2008 | Nakanishi | 482/51 |
| 7,347,806 | B2 * | 3/2008 | Nakano et al. | 482/51 |
| 7,608,017 | B2 * | 10/2009 | Nakanishi | 482/51 |
| 2006/0073940 | A1 | 4/2006 | Nakanishi | |
| 2008/0009395 | A1 * | 1/2008 | Tseng | 482/51 |

FOREIGN PATENT DOCUMENTS

| | | |
|---|---|---|
| EP | 1 867 366 | 12/2007 |
| JP | 11-004911 | 1/1999 |
| JP | 2001-286578 | 10/2001 |
| JP | 2006-101982 | 4/2006 |
| JP | 2007-167289 | 7/2007 |
| WO | 2006/038471 | 4/2006 |

* cited by examiner

*Primary Examiner*—Steve R Crow
(74) *Attorney, Agent, or Firm*—Bacon & Thomas, PLLC

(57) ABSTRACT

A rocking type exercising apparatus includes a movable unit on which a user rides and a driving unit for causing the movable unit to perform a rocking motion. The driving unit includes a pitch driving part for causing the movable unit to rock in a forward/backward direction, a roll driving part for causing the movable unit to rock in a leftward/rightward direction and a yaw driving part for causing the movable unit to rotate about a vertical axis. When the movable unit is moved forward by the pitch driving part and is tilted to either the left or the right by the roll driving part, the yaw driving part rotates the movable unit in the same direction as the tilted direction of the movable unit.

11 Claims, 12 Drawing Sheets

ROCKING TYPE EXERCISING APPARATUS

FIELD OF THE INVENTION

The present invention relates to a rocking type exercising apparatus for providing a user with an exercising effect similar to a horse riding by rocking a seat on which the user sits and for urging the user to maintain a balance by rocking treadles on which the user straddles.

BACKGROUND OF THE INVENTION

A rocking type exercising apparatus for providing a user with an exercising effect similar to a horse riding is an easy-to-use exercising apparatus that is widely used among users of various generations from children to elderly persons and is spread to general households as well as rehabilitation purpose medical facilities. Examples of the conventional rocking type exercising apparatus are disclosed in, e.g., Japanese Patent No. 3394890 and Japanese Patent Laid-open Application No. 2001-286578.

Japanese Patent No. 3394890 discloses a prophylactic training apparatus for lumbago that can realize a rhythmical rocking motions using a parallel mechanism having a leeway of movement in six different direction or the like. Japanese Patent Laid-open Application No. 2001-286578 discloses a balance training apparatus that can realize a forward/backward rocking motion and a leftward/rightward rocking motion using a motor and a link.

The balance training apparatus disclosed in Japanese Patent Laid-open Application No. 2001-286578 enables a movable unit to merely perform the combination of a forward/backward rocking motion and a leftward/rightward rocking motion but is not able to comply with the need for a user to enjoy a more effective exercise (a passive exercise).

In contrast, the prophylactic training apparatus disclosed in Japanese Patent No. 3394890 is capable of causing a movable unit to make a leeway of movement in six different direction and therefore is able to meet the afore-mentioned need. However, the prophylactic training apparatus is problematic in terms of cost and is hard to drive in a controlled manner. The prophylactic training apparatus allows a movable unit to merely perform the combination of a forward/backward rocking motion and a leftward/rightward rocking motion.

SUMMARY OF THE INVENTION

In view of the above, the present invention provides a rocking type exercising apparatus capable of effectively and conveniently performing a yawing motion in addition to forward/backward and leftward/rightward motions (pitching and rolling motions).

In accordance with the present invention, there is provided a rocking type exercising apparatus including: a movable unit on which a user rides; and a driving unit for causing the movable unit to perform a rocking motion, wherein the driving unit includes a pitch driving part for causing the movable unit to rock in a forward/backward direction, a roll driving part for causing the movable unit to rock in a leftward/rightward direction and a yaw driving part for causing the movable unit to rotate about a vertical axis and wherein, when the movable unit is moved forward by the pitch driving part and is tilted to either the left or the right by the roll driving part, the yaw driving part rotates the movable unit in the same direction as the tilted direction of the movable unit.

With the rocking type exercising apparatus described above, a yawing motion is added to the backward/forward pitching motion and the leftward/rightward rolling motion by the driving unit that includes the yaw driving part in addition to the pitch driving part and the roll driving part. Furthermore, at the timing when the user can enjoy a more effective passive exercise, the yawing motion is added to the combination of the forward rocking motion and the leftward/rightward rocking motion caused by the combination of the pitching motion and the rolling motion.

The roll driving part of the driving unit may cause the movable unit to make a leftward/rightward rocking motion by rotating the movable unit about a forward/backward axis inclined with respect to the movable unit, and a yaw component acting about the vertical axis may be preferably added to the movement of the movable unit by making the distance between the forward/backward axis and a front end of the movable unit different from the distance between the forward/backward axis and a rear end of the movable unit.

With this configuration, the roll driving part serves as the yaw driving part. This is cost-effective as compared to a case where the yaw driving part is provided independently. This also eliminates the possibility that operation timings of the rolling motion and the yawing motion are deviated from each other.

The forward/backward axis may have such an inclination that a front end of the axis lies lower than a rear end of the axis, and the distance between the forward/backward axis and the front end of the movable unit may be greater than the distance between the forward/backward axis and the rear end of the movable unit.

With this configuration, it is possible to obtain the yawing motion by which the front end of the movable unit is swayed to the left and right. This makes it possible to more effectively apply the yawing motion to the user who rides on the movable unit, while allowing the user to really feel that the yawing motion is added.

It is preferable that the pitch driving part and the roll driving part are driven together by a rotational output of a single motor. With this configuration, it is possible to easily obtain a combination of the pitching motion, the rolling motion and the yawing motion at a desired timing.

In accordance with the embodiment of the present invention, the yaw driving part for rotating the movable unit about the vertical axis is provided in addition to the pitch driving part and the roll driving part.

This makes it possible to add the yawing motion to the forward/backward pitching motion and the leftward/rightward rolling motion. Furthermore, when the movable unit is moved forward by the pitch driving part and is tilted to either the left or the right by the roll driving part, the yaw driving part rotates the movable unit in the same direction as the tilted direction thereof. Therefore, at the timing when the user can enjoy a more effective passive exercise, the yawing motion is added to the combination of the forward rocking motion and the leftward/rightward rocking motion caused by the combination of the pitching motion and the rolling motion.

Also, it is possible to apply to the movable unit a motion extremely effective in training the legs and the waist of the user and enhancing the sense of balance. Further, because the pitch driving part, the roll driving part and the yaw driving part are provided together, the rocking type exercising apparatus of the present invention is made in a cost-effective manner and the operation thereof can be controlled with ease as compared to the conventional ones that employ a parallel mechanism having a leeway of movement in six different direction.

BRIEF DESCRIPTION OF THE DRAWINGS

The object and features of the present invention will become apparent from the following description of embodiments given in conjunction with the accompanying drawings, in which.

DETAILED DESCRIPTION OF THE EMBODIMENT

Hereinafter, an exemplary embodiment of the present invention will be described with reference to FIGS. 1 to 12, which form a part hereof.

Figure 2:
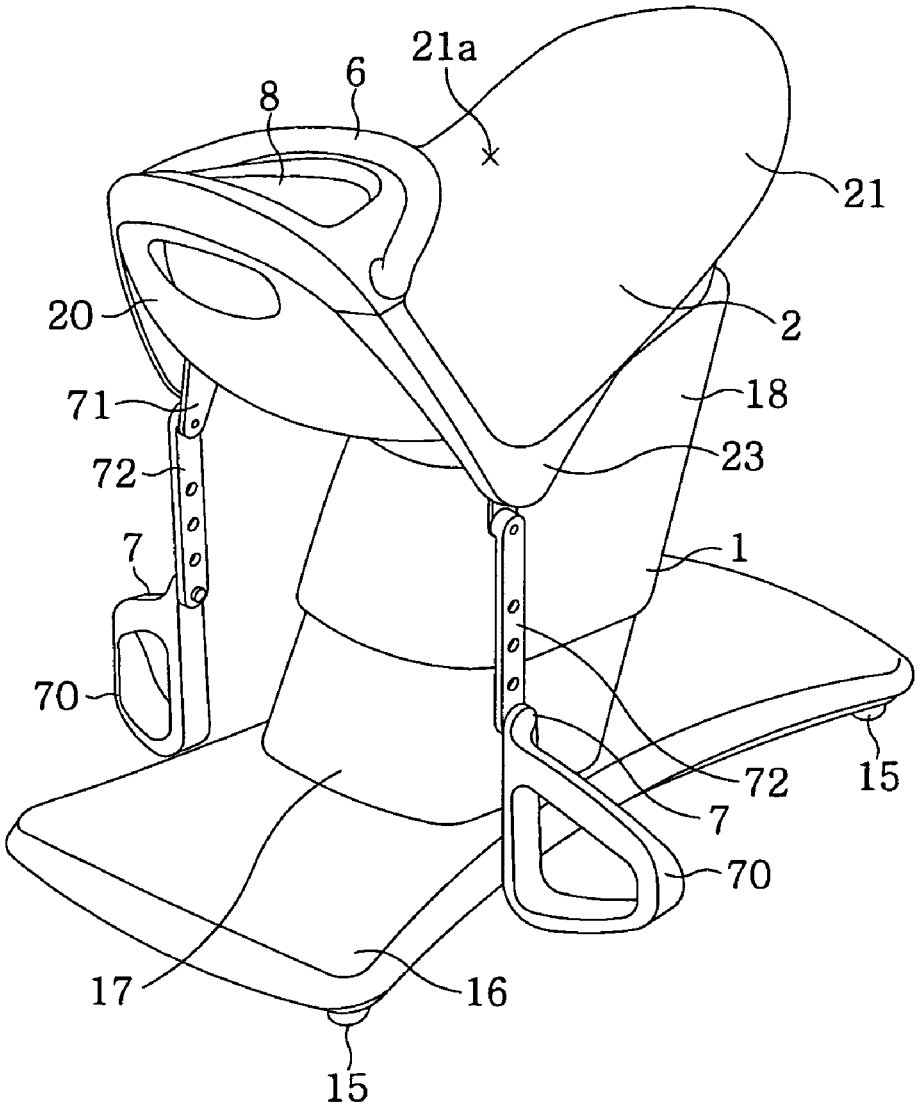
FIG. 2 is a perspective view of the rocking type exercising apparatus.
Figure 3A:
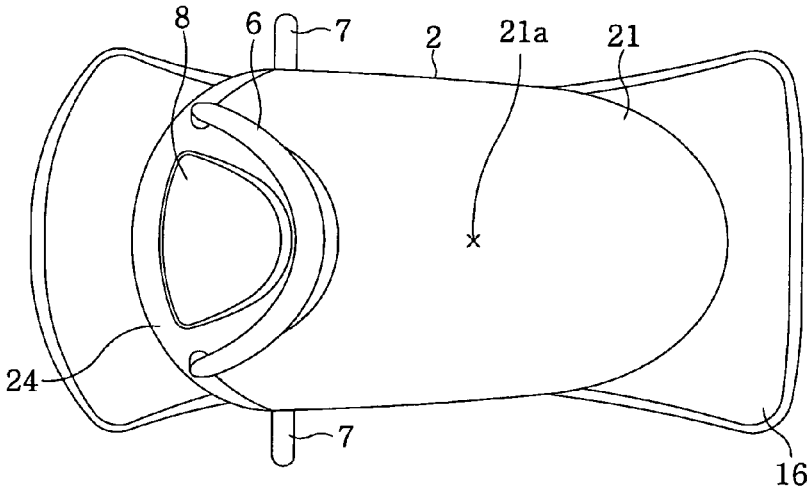
FIGS. 3A and 3B are plan and right side views of the rocking type exercising apparatus.
Figure 3B:
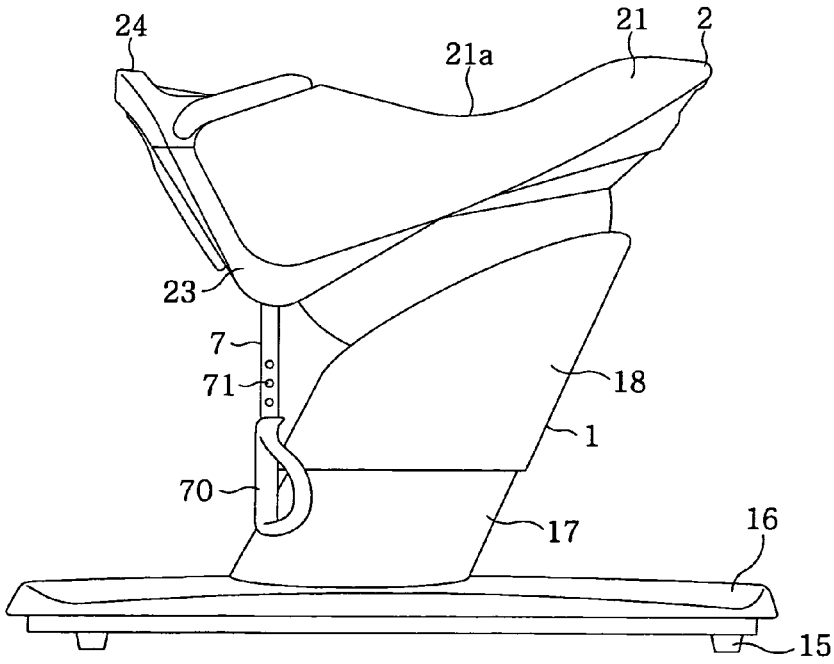
Figure 4:
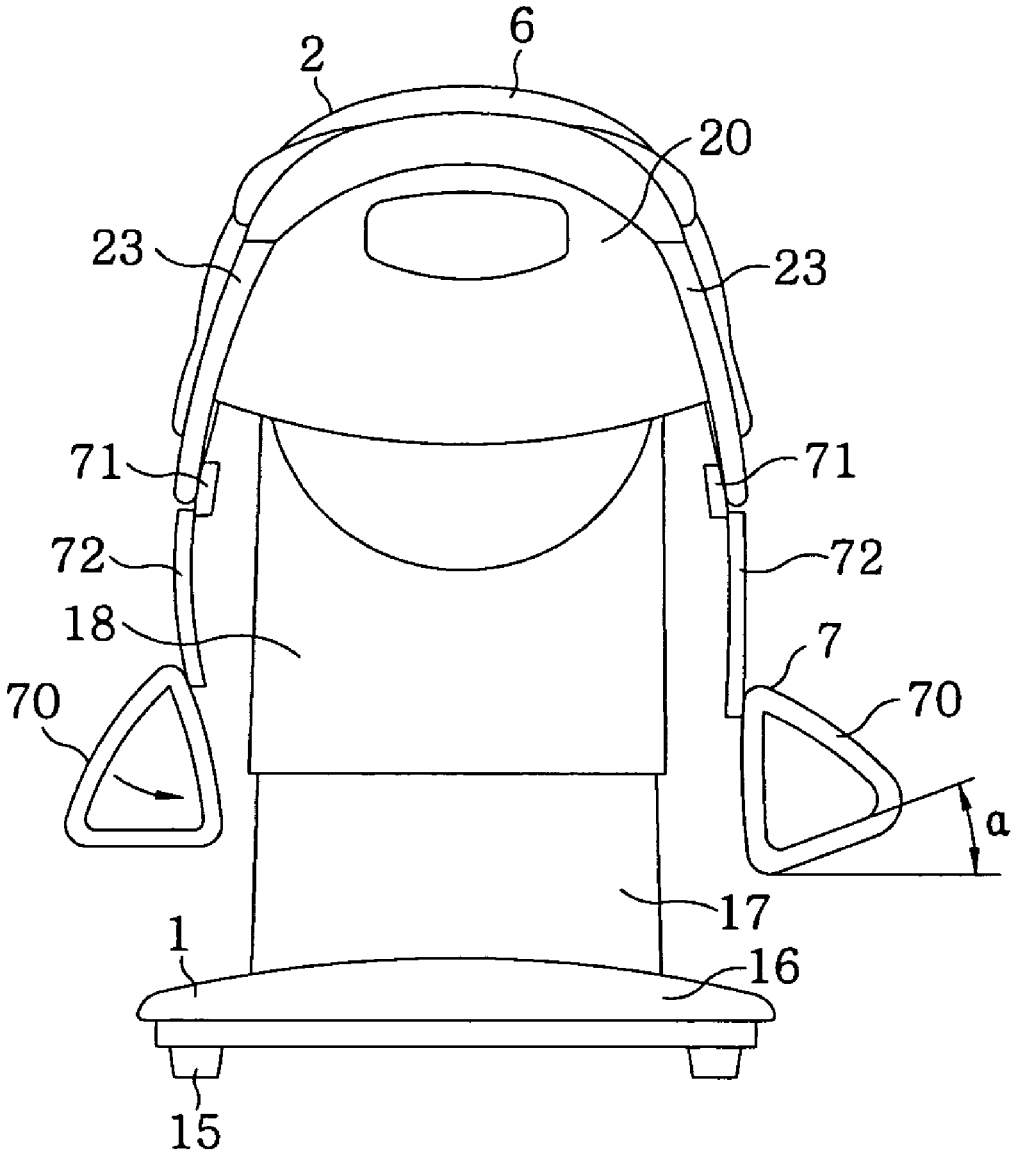
FIG. 4 is a front view of the rocking type exercising apparatus.

The rocking type exercising apparatus shown in FIGS. 2 and 3 is designed to cause forward/backward and leftward/rightward rocking motions to a seat 2 on which a user sits, so that the user sitting on the seat 2 can take an exercise for balance training purposes. The rocking type exercising apparatus includes a seat 2 imitating a horseback or a saddle in shape and having a top seat surface, a driving unit 3 for causing a rocking motion to the seat 2 and a main body 1 for receiving the driving unit 3 within an upper portion thereof. A generally semicircular arc-shaped rein 6 is connected at its opposite ends to the front end side of the seat 2 in a manner that the rein 6 is pivotably moved in the forward/backward direction. An operation panel 8 is also provided on the front end side of the seat 2. Stirrup members 7 and 7 are suspended from the opposite flanks of the seat 2 near the front end of the latter.

Figure 5:
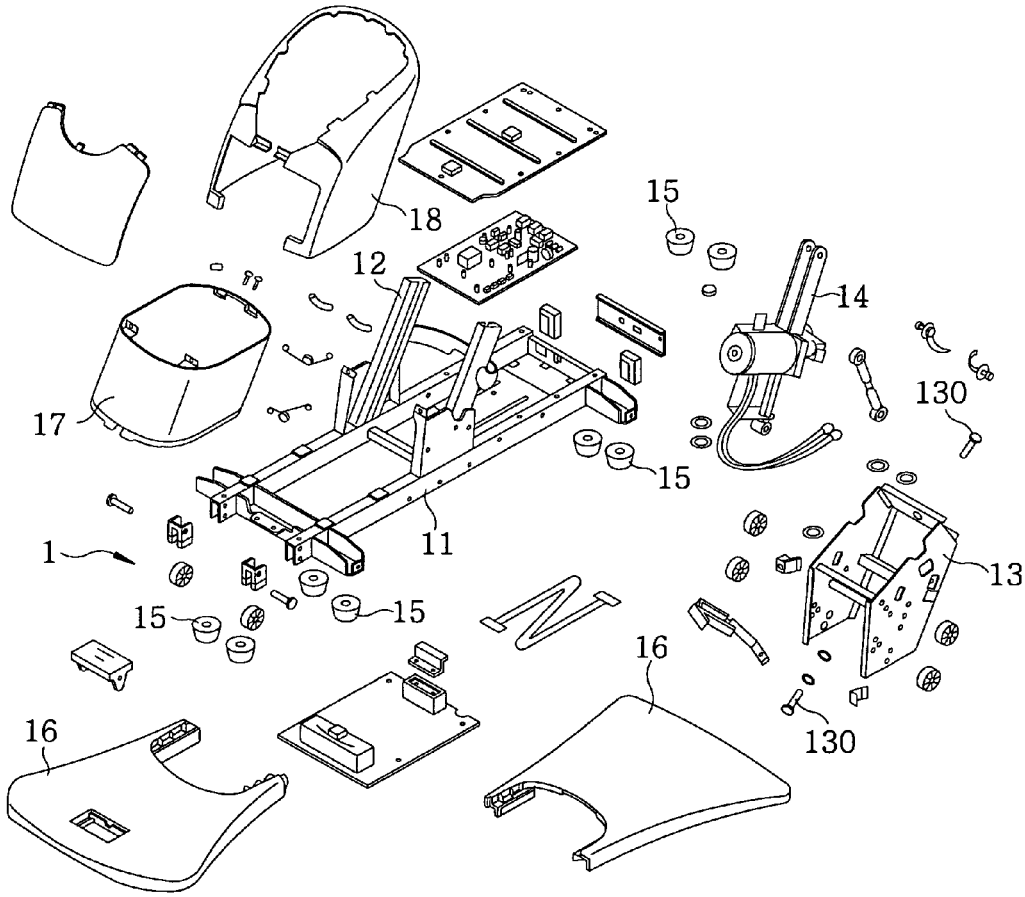
FIG. 5 is an exploded perspective view showing a main body unit of the rocking type exercising apparatus.

As can be seen in FIG. 5, the main body 1 includes a base frame 11 having ground-contacting legs 15 at its four corners, a post 12 extending upwardly and rearwardly from the generally central portion of the base frame 11, a support frame 13 attached to the post 12 in a manner that the support frame 13 is slidably movable in the longitudinal direction of the post 12 and an electrical sliding unit 14 for performing the sliding movement of the support frame 13 with electric power. The main body 1 further includes a base cover 16 for covering the upper surface of the base frame 11, a cover 17 for covering the vicinity of the post 12, and a main cover 18 for covering the outer circumference of the support frame 13.

Figure 6:
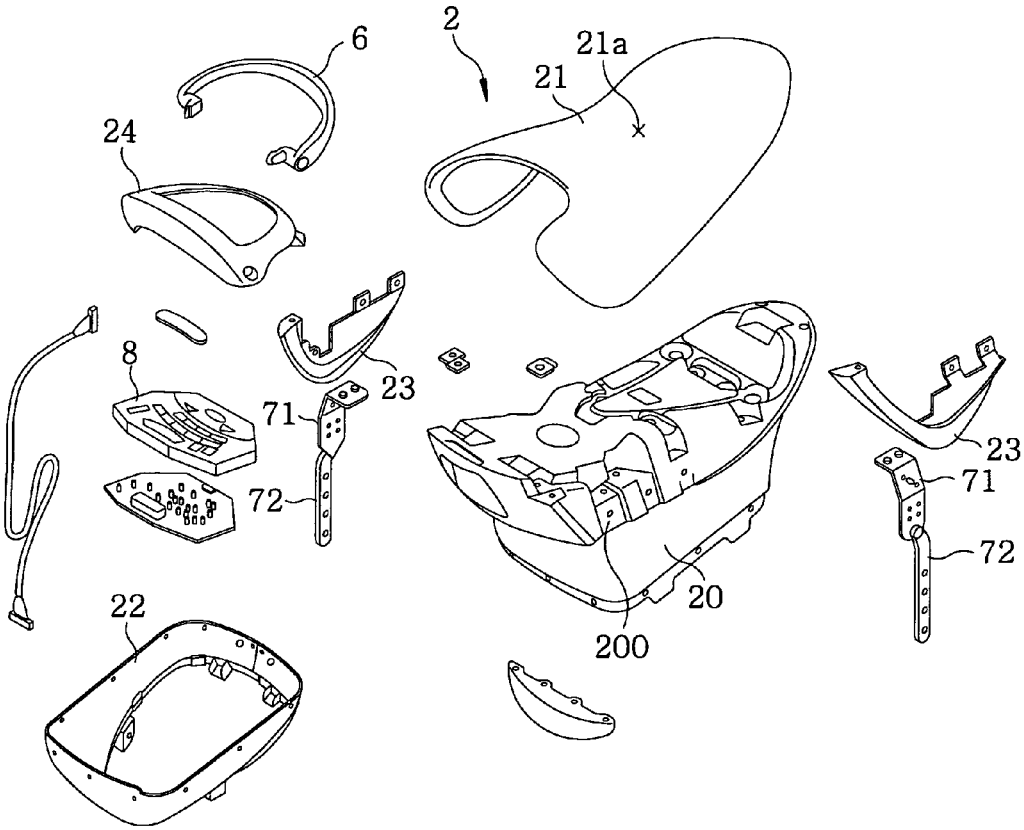
FIG. 6 is an exploded perspective view showing a seat of the rocking type exercising apparatus.
Figure 7:
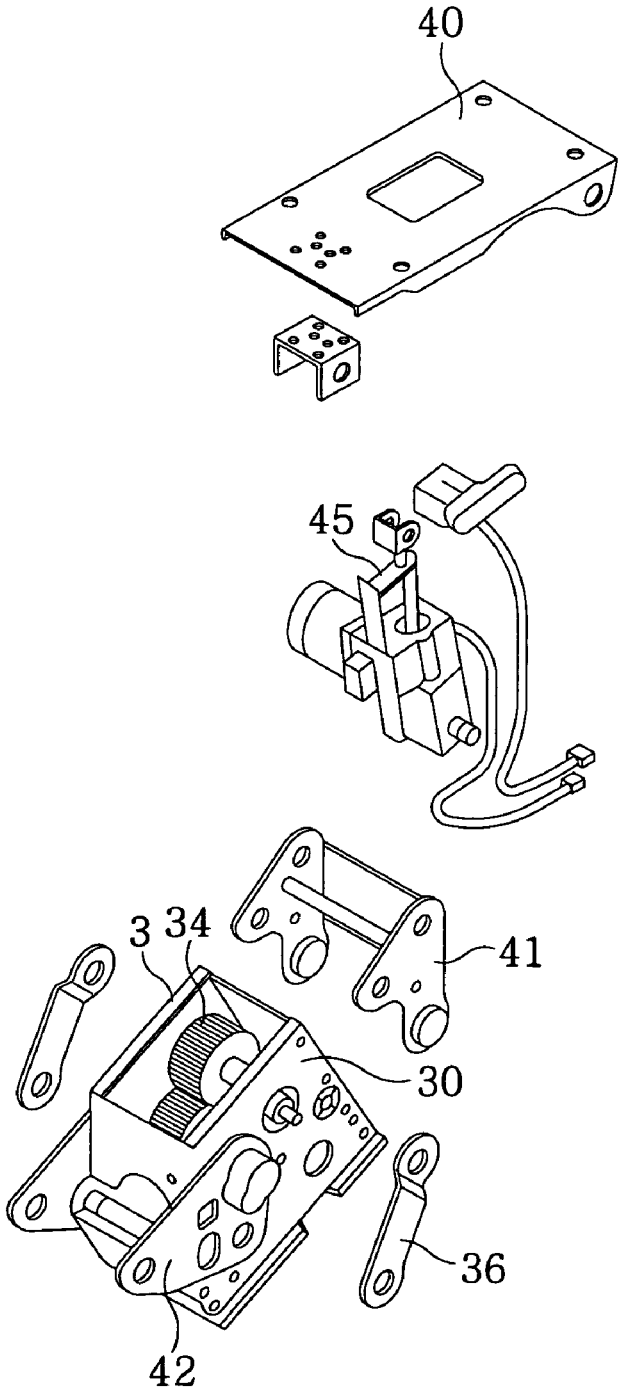
FIG. 7 is an exploded perspective view showing a driving unit of the rocking type exercising apparatus.
Figure 8:
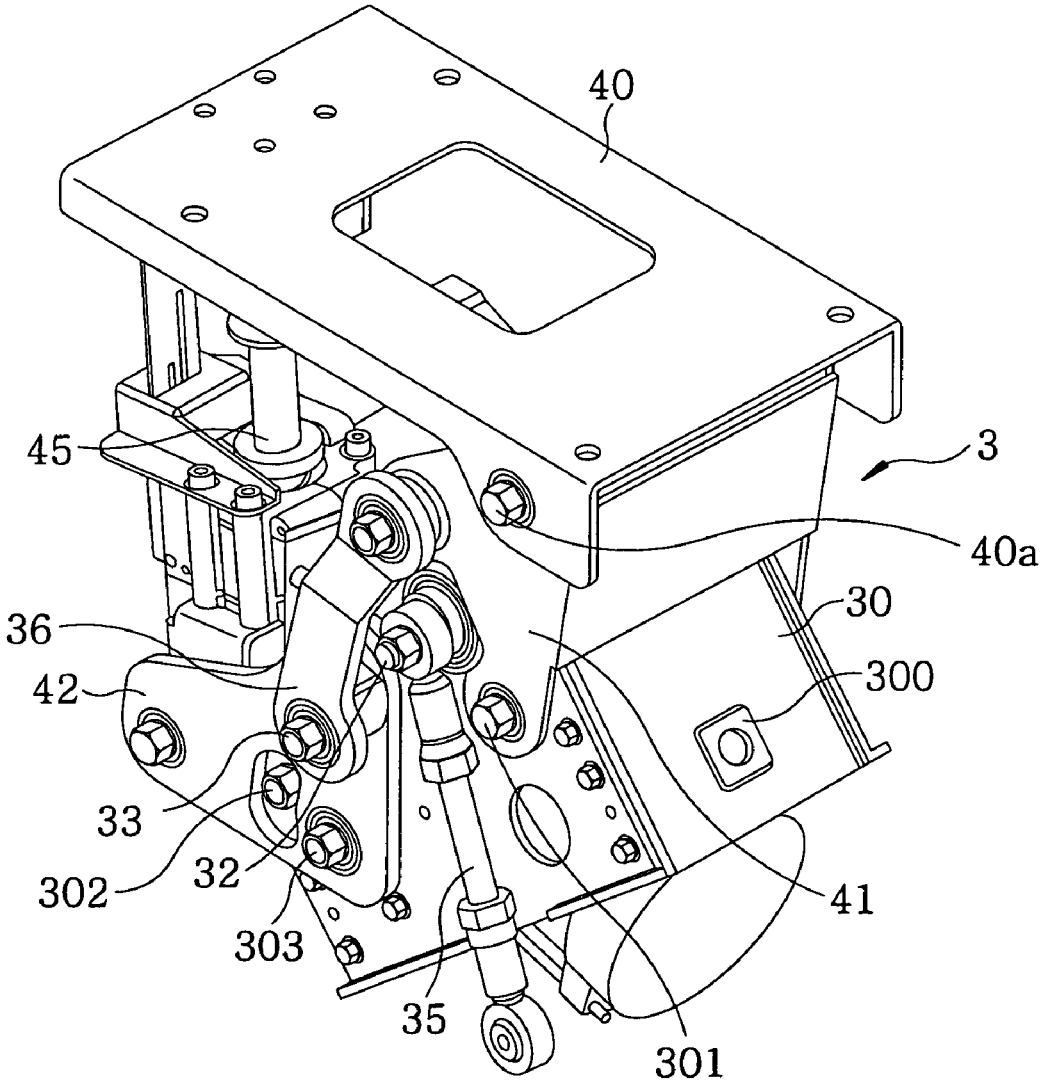
FIG. 8 is a perspective view of the driving unit of the rocking type exercising apparatus.

Referring to FIG. 6, the seat 2 includes a seat frame 20, a seat surface member 21 attached to the upper surface of the seat frame 20, a cover 22 joined to the lower side of the seat frame 20, a pair of protection covers 23 attached to the left and right sides of the seat frame 20, and a panel cover 24 for covering the vicinity of the operation panel 8.

Each of the stirrup members 7 includes a fixed piece 71 fixedly secured to a stirrup attachment portion 200 formed on each side surface of the seat frame 20, a connection piece 72 suspended from the fixed piece 71, and a foot rest 70 suspended from the connection piece 72. Each of the protection covers 23 covers the outer end of a joint pin portion by which the connection piece 72 is joined to the fixed piece 71, thereby preventing a possibility that the knee portion of the user sitting on the seat 2 comes into contact with the joint pin portion.

The driving unit 3 will now be described. Referring to FIGS. 7 to 10, the driving unit 3 includes a movable frame 30 formed into a box-like shape, a motor 31 arranged within the movable frame 30, a gear group 34 arranged within the movable frame 30 for transferring the torque of the motor 31 to a couple of output shafts 32 and 33, a movable plate 40 positioned above the movable frame 30, and two kinds of link plates 41 and 42 for connecting the movable plate 40 to the movable frame 30. The gear group 34 serves as a speed reduction means which reduces a rotational speed of the motor. The movable frame 30 has bearing portions 300 at its front and rear end surfaces. The bearing portions 300 of the movable frame 30, are rotatably attached to the support frame 13 of the main body 1 by respective shafts 130 (shown in FIG. 5), so that the movable frame 30 swings in the leftward and rightward directions about the shafts 130.

In this regard, the link plate 41 connected to the rear end side of the movable plate 40 is coupled to the rear side surfaces of the movable frame 30 by means of a shaft 301. A rotating plate 39 is arranged within the movable frame 30 and is supported at one end by the movable frame 30 by means of a shaft 302. The link plate 42 is supported by the other end of the rotating plate 39 by means of a shaft 303. Furthermore, the link plate 42 is connected to the front end of the movable plate 40 through an extensible/contractible actuator 45.

The two output shafts 32 and 33 are pivotably driven, of which the output shaft 32 has an off-centered portion lying on the external surface of the movable frame 30. The off-centered portion is connected to the support frame 13 through a link 35, thereby forming a roll driving part.

The output shaft 33 has two off-centered portions 33*a* and 33*b* lying on the external surface of the movable frame 30. The off-centered portion 33*a* with reduced eccentricity is connected to the link plate 42, while the off-centered portion 33*b* with increased eccentricity is connected to one end of a connection link 36 of which the other end is connected to the link plate 41, thereby forming a pitch driving part.

Figure 9:
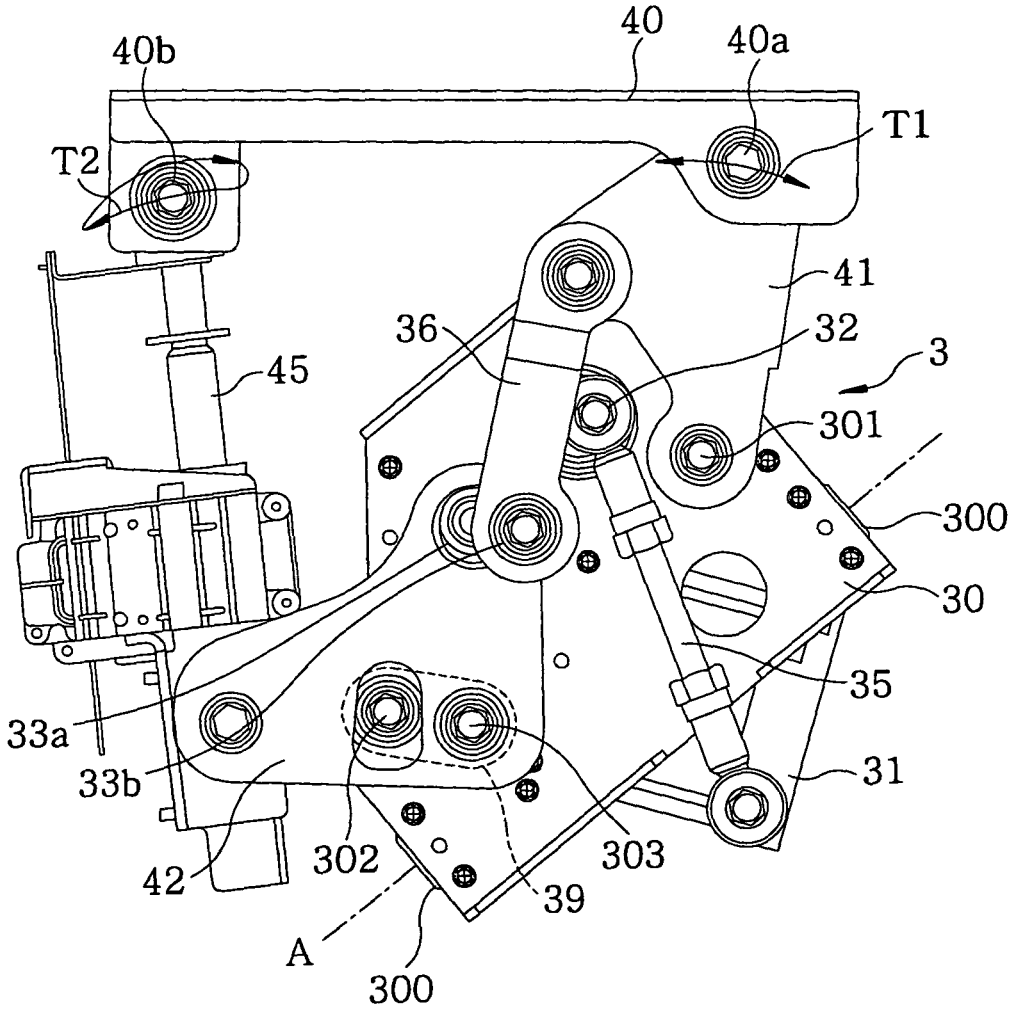
FIG. 9 is a side view of the driving unit of the rocking type exercising apparatus.
Figure 10:
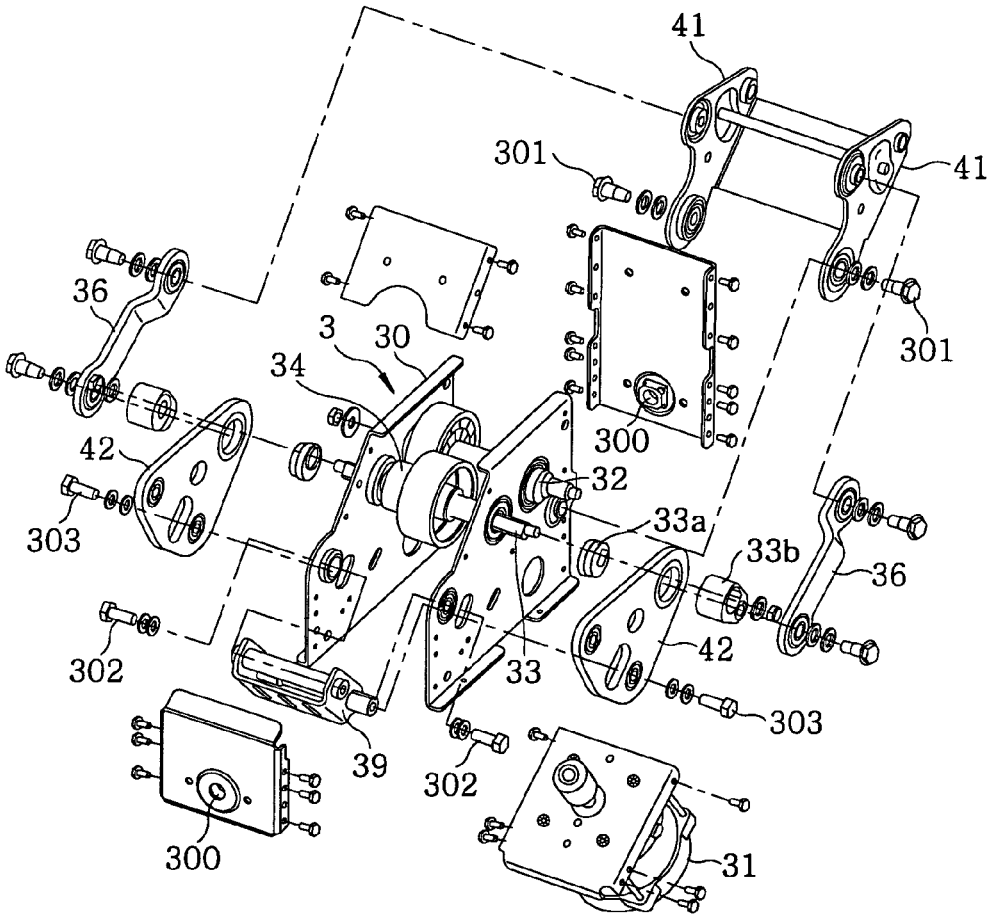
FIG. 10 is an exploded perspective view of the driving unit of the rocking type exercising apparatus.

Rotation of the off-centered portion of the output shaft 32 connected to the support frame 13 through the link 35 causes the movable frame 30 to reciprocatingly rotate about the shafts 130 (extending along the longitudinal axis A inclined in the forward/backward direction in FIG. 9).

Figure 11:
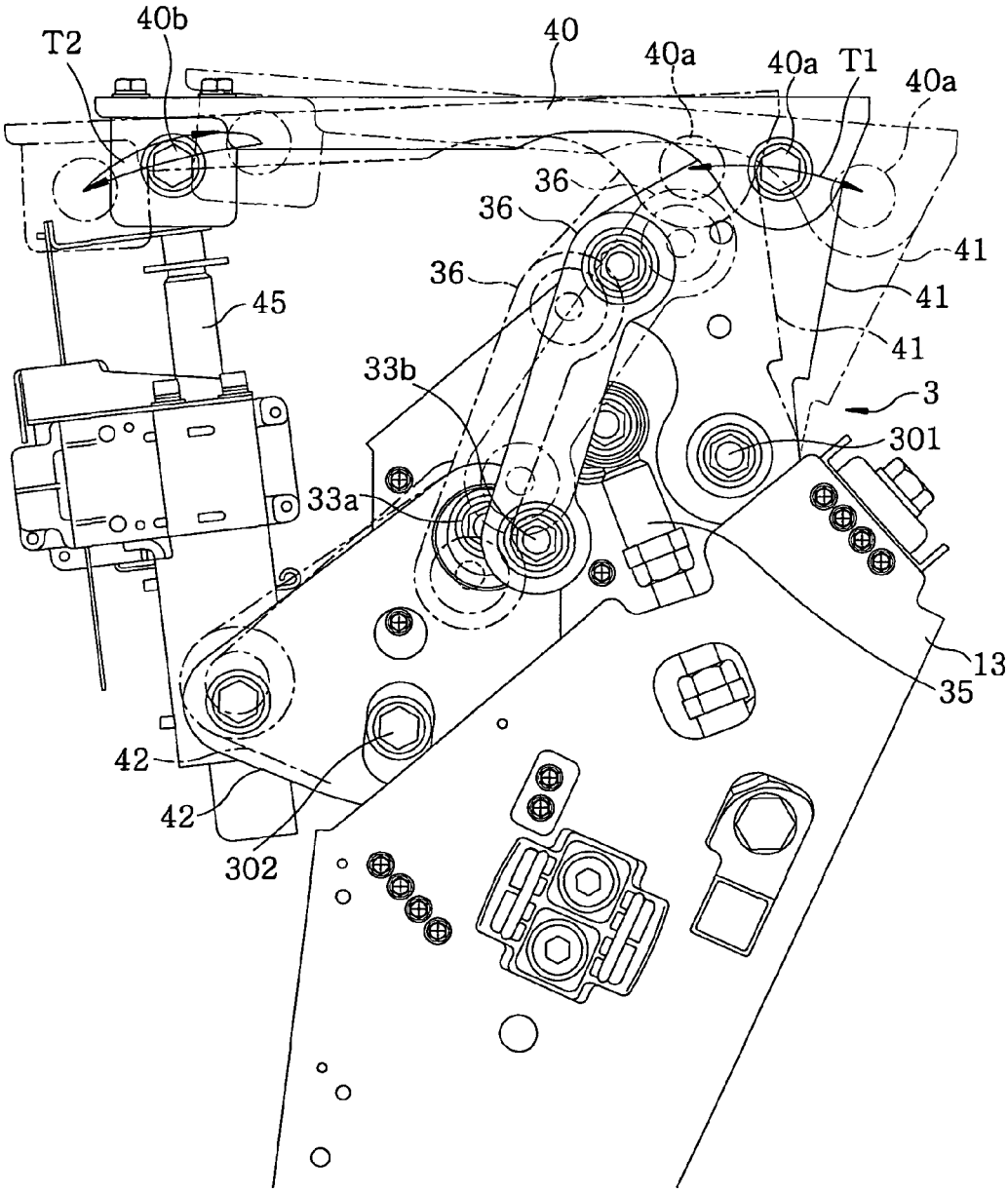
FIG. 11 is a view for explaining the forward/backward rocking motion of the driving unit of the rocking type exercising apparatus.

Eccentric rotation of the off-centered portion 33*a* of the output shaft 33 causes the front end of the movable plate 40 to swing in the forward/backward and upward/downward directions through the intervention of the link plate 42 and the extensible/contractible actuator 45. Eccentric rotation of the off-centered portion 33*b* causes the rear end of the movable plate 40 to swing primarily in the forward/backward direction through the intervention of the connection link 36 and the link plate 41. Assuming that the trajectory of forward/backward swinging movement of a joint shaft 40*a* for joining the link plate 41 and the movable plate 40 together is T1 and the trajectory of forward/backward swinging movement of a joint shaft 40*b* for joining the extensible/contractible actuator 45 and the movable plate 40 together is T2 as illustrated in FIGS. 9 and 11, the strokes of both swinging movement are set equal to each other but the upward/downward movement components are set differently in the trajectories T1 and T2.

In addition, although the trajectory T1 is mainly moved in the forward/backward direction, the trajectory T2 has an increased upward/downward movement component in addition to the forward/backward movement component. This is because the shaft 303 of the link plate 42 is located rearwardly of the shaft 40*b*. Furthermore, the trajectory T2 goes forward and comes back via different routes deviated in the upward/backward direction, because the rotating plate 39 constituting one of the constituent parts for driving rocking motion of the front end of the movable plate 40 changes the position of the shaft 303 as a rotational axis of the link plate 42 in the upward/backward direction.

Figure 1A:
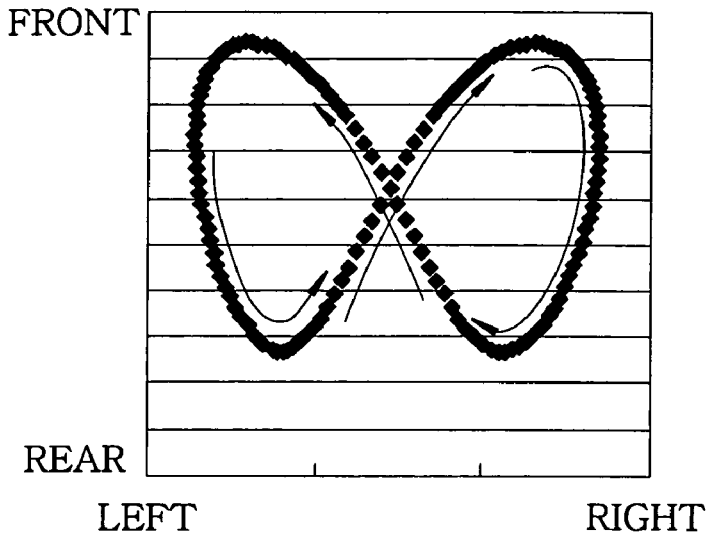
FIGS. 1A and 1B are views for explaining the operation of a rocking type exercising apparatus in accordance with an embodiment of the present invention.

In this connection, the seat frame 20 of the seat 2 is fixed to the movable plate 40 that makes a rocking motion in the forward/backward and leftward/rightward directions as the output shafts 32 and 33 are rotated, whereby the seat 2 rocks together with the movable plate 40 in the forward/backward and leftward/rightward directions. The revolution number of the output shafts 32 and 33 is set to ensure that two cycles of the forward/backward rocking motion are performed during one cycle of the leftward/rightward rocking motion. A center point 21*a* of the seat surface member 21 of the seat 2 is positioned at a center in the leftward/rightward direction and at lowermost in the forward/backward direction. Two cycles of forward/backward rocking motion are performed during one cycle of leftward/rightward rocking motion, so that the center point 21*a* is described in a figure eight pattern, when viewed from the top, during the forward/backward and leftward/rightward rocking motion of the seat 2 as illustrated in FIG. 1A. Due to the difference in the trajectories T1 and T2, the center point 21*a* of the seat 2 goes down while moving forward but goes up while coming back as illustrated in FIG. 1B.

Further, as illustrated above, the trajectory T1 of the rear end of the seat 2 signifies a forward/backward motion with a reduced upward/downward motion component, on the other hand, the trajectory T2 of the front end of the seat 2 stands for a forward/backward motion with an increased upward/downward motion component. Thus, the upward/downward motion of the seat 2 is performed in such a way that the front end is moved up and down with respect to the rear end. The user sitting on the seat 2 in a position substantially coinciding with the center point 21*a* of the seat 2 can accurately feel the motion of the seat 2, that is, the upward/downward movement of the front end with respect to the rear end lying behind the user.

Figure 1B:
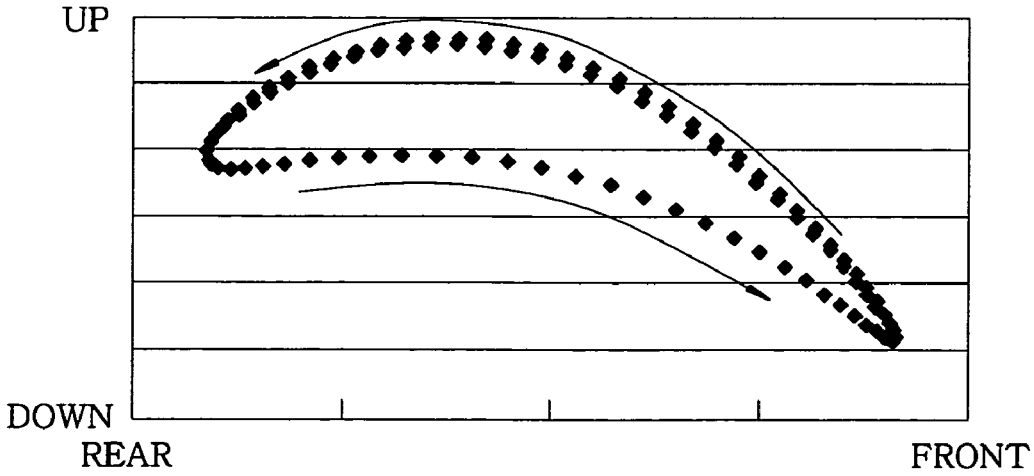

FIGS. 1A and 1B are graphs obtained by plotting the movement of the center point 21*a* of the seat 2 at regular time intervals. In this graph, the section having a greater interval between dots signifies high speed movement and the section where a narrower interval is changed to a broader interval within a short period of time represents movement with increased acceleration. FIGS. 1A and 1B show that the acceleration at the forward motion is greater than the acceleration at the backward motion. A user, who sits on the seat 2 and takes the motions of the seat 2, feels a sense of forward movement. Therefore, the user can have a sense as if he or she enjoys actual horse riding.

The leftward/rightward rocking motion does not occur about a horizontal axis generally parallel to the movable plate 40 but about the longitudinal axis A whose front end is lower than its rear end. Accordingly, though the movable plate 40 performs a leftward/rightward rocking motion within an equal angular extent at the front and rear ends, the leftward/rightward stroke of the movable plate 40 at the front end is greater than the stroke at the rear end. This is because the vertical distance between the front end of the movable plate 40 and the longitudinal axis A is greater than the vertical distance between the rear end of the movable plate 40 and the longitudinal axis A. The forward/backward rocking motion (pitching) is combined with the leftward/rightward rocking motion (rolling). In the figure eight pattern trajectory as observed from the top, the leftward/rightward motion width at the front side becomes greater than that at the rear side as is apparent in FIG. 1A. Furthermore, the forward tilting motion includes a yawing motion component by which the front end of the seat 2 is obliquely twisted forward and moved criss-cross which implies that the roll driving part serves as a yaw driving part.

Therefore, the user, who sits on the seat 2 and takes all the motions of the seat 2, cannot maintain a balance unless he or she copes with the yawing motion as well as the pitching and rolling motions. This is quite effective from the standpoint of balance training.

The extensible/contractible actuator 45 of the driving unit 3 is provided for the purpose of changing the forward/backward inclination angle of the seat 2. In response to the manipulation of the operation panel 8, the extensible/contractible actuator 45 is extended and contracted to change over the forwardly inclined posture and the backwardly inclined posture. In addition, the extensible/contractible actuator 45 may be allowed to perform extending and contracting motions in concert with the forward/backward and leftward/rightward rocking motions, thereby increasing or decreasing the upward/downward motion component.

If the forward/backward inclination angle of the seat 2 is changed, so are the loads applied to individual muscles (abdominal muscles, back muscles, front-of-thigh muscles and back-of-thigh muscles) of the user during the rocking motion of the seat 2. The change in the rocking speed may also lead to a change in the load intensity and the ratio of the loads applied to the individual muscles. In order for the user to be clearly aware of such change, the status of loads applied to the respective muscles is displayed on the operation panel 8 as will be set forth later. The status of load is decided based on the data obtained in advance as to how the myogenic potentials of the respective muscles vary with the difference in the forward/backward inclination angle and the speed of the motor 31.

When the user sits on the seat 2 and takes all the motions of the seat 2, the user can enjoy the rocking motion in a safer manner by resting the foot on the stirrup members 7 and holding the rein 6 with the hands. The stirrup members 7 are designed so that the joint point between the connection piece 72 and the foot rest 70 can be adjusted in the vertical direction. This makes it possible to set the height of the stirrup members 7 in conformity with the physique and preference of the user.

The connection piece 72 is made of an elastic material and is freely bendable to the left and right. As is clear from the right stirrup member 7 shown in FIG. 4, the foot rest 70 joined to the outer surface of the connection piece 72 has a bottom portion that extends outwardly upwardly at an inclination angle α. By allowing the foot rest 70 to be off-set outwardly, it becomes easy for the user to rest the foot on the foot rest 70. Once the foot is rested on the foot rest 70 of each of the stirrup members 7, the elastic connection piece 72 is bent to have the foot rest 70 move inwardly, thereby bring the bottom portion of the foot rest 70 into a horizontal state as is apparent from the left stirrup member 7 shown in FIG. 4. Therefore, when the feet are placed on the stirrup members 7, it is possible for the user to maintain a good posture with no possibility that an exceedingly high force is applied to the ankles or the knees.

Figure 12:
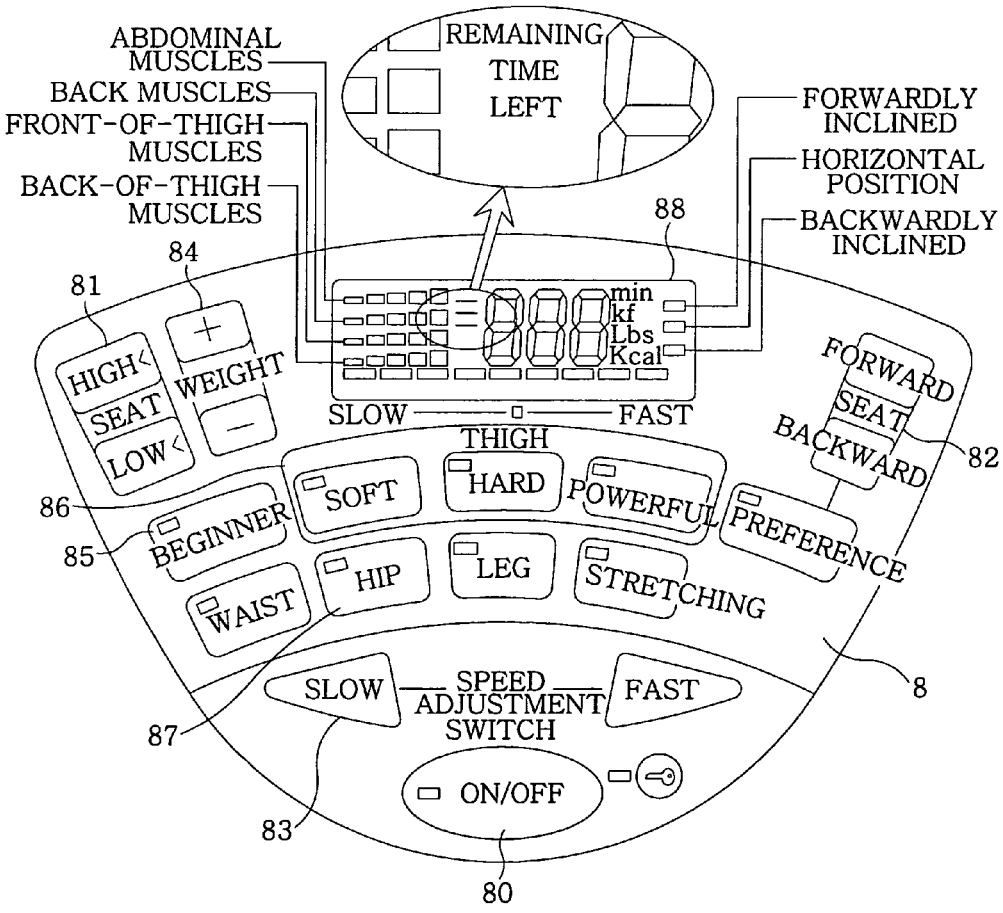
FIG. 12 is a front view showing an operation panel of the rocking type exercising apparatus.

FIG. 12 shows the operation panel 8 of arranged in the front end portion of the seat 2. In this figure, reference numeral 80 designates a power switch, reference numeral 81 is a height adjustment switch for operating the electrical sliding unit 14 to adjust the height of the seat 2, reference numeral 82 designates an angle adjustment switch for operating the extensible/contractible actuator 45 to adjust the inclination angle of the seat 2, and reference numeral 83 designates a speed adjustment switch for changing the rotational speed of the motor 31 of the driving unit 3 to control the rocking speed.

Reference numeral 84 designates an up/down switch for inputting the weight value of a user, reference numeral 85 designates an operation mode selection switch for selecting a rocking motion to be suitable for a beginner, reference numeral 86 designates an operation mode conversion switch for converting the intensity of an exercise offered by the rocking motion, reference numeral 87 designates an exercise target conversion switch for converting an exercise target, and reference numeral 88 designates a display formed of a liquid crystal panel. Upon operating the exercise target conversion switch 87, the forward/backward inclination angle of the seat 2 is suitably converted by means of the extensible/contractible actuator 45.

The display 88 serves to indicate the inclination status of the seat 2, the speed adjustment status, the operation time, the exercise intensity, the calculated exercise amount (consumed calories), and the loads to be applied to abdominal muscles, back muscles, front-of-thigh muscles and back-of-thigh muscles by the speed change and the change in the forward/backward inclination postures of the seat 2 resulting from extension and contraction of the extensible/contractible actuator 45.

The exercise amount may be preferably calculated based on the rocking amount (data corresponding to the exercising amount per unit time) calculated in advance for respective forward/backward inclination postures and operation speeds of the seat 2, the inputted weight value, and the operation time. However, it may also be possible to install an acceleration sensor in the driving unit 3 or the seat 2 and calculate the exercise amount using acceleration data obtained from the acceleration sensor.

While the embodiment described above is directed to a rocking type exercising apparatus that allows a user to enjoy an exercise like horse riding, the present invention is not limited thereto. Alternatively, the present invention may be applicable to an apparatus of the type allowing a user to take an exercise like surfing for example by rocking a footrest on which the user stands. The present invention may also be applicable to an apparatus of the type enabling a user to take an exercise like walking by rocking a seat on which a user sits while individually moving up and down each of footrests on which each of the feet of the user is placed.

In the foregoing embodiment, the addition of the yaw component to the motion of the seat 2 as a movable unit is accomplished by inclining the shaft A about which the leftward/rightward rocking motion occurs and making the distance between the shaft A and the front end of the seat 2 (the movable plate 40) different from the distance between the shaft A and the rear end of the seat 2. Alternatively, the addition of the yaw component may be accomplished by adding to the driving unit 3 a rotational movement mechanism, as a yaw driving part, for rotating the seat 2 (the movable plate 40) about a vertical axis in concert with the forward/backward and leftward/rightward rocking motions thereof.

While the invention has been shown and described with respect to the embodiments, it will be understood by those skilled in the art that various changes and modifications may be made without departing from the scope of the invention as defined in the following claims.

What is claimed is:

1. A rocking type exercising apparatus comprising:

a movable unit on which a user rides; and a driving unit for causing the movable unit to perform a rocking motion, wherein the driving unit includes a pitch driving part for causing the movable unit to rock in a forward/backward direction, a roll driving part for causing the movable unit to rock in a leftward/rightward direction and a yaw driving part for causing the movable unit to rotate about a vertical axis, wherein, when the movable unit is moved forward by the pitch driving part and is tilted to either the left or the right by the roll driving part, the yaw driving part rotates the movable unit in the same direction as the tilted direction of the movable unit, wherein a center point of the movable unit displaces downward while moving forward and displaces upward while moving backward, and wherein two cycles of a forward/backward rocking motion are performed during one cycle of a leftward/rightward rocking motion.

2. The rocking type exercising apparatus of claim 1, wherein the roll driving part of the driving unit causes the movable unit to make the leftward/rightward rocking motion by rotating the movable unit about a forward/backward axis inclined with respect to the movable unit and wherein a yawing motion about the vertical axis is added to the movement of the movable unit by making the distance between the forward/backward axis and a front end of the movable unit different from the distance between the forward/backward axis and a rear end of the movable unit.

3. The rocking type exercising apparatus of claim 2, wherein the forward/backward axis has such an inclination that a front end of the axis lies lower than a rear end of the axis and wherein the distance between the forward/backward axis and the front end of the movable unit is greater than the distance between the forward/backward axis and the rear end of the movable unit.

4. The rocking type exercising apparatus of claim 2, wherein the pitch driving part and the roll driving part are driven together by a rotational output of a single motor.

5. The rocking type exercising apparatus of claim 3, wherein the pitch driving part and the roll driving part are driven together by a rotational output of a single motor.

6. The rocking type exercising apparatus of claim 2, wherein the pitch driving part causes the front end of the movable unit to swing in the forward/backward direction and an upward/downward direction, and causes the rear end of the movable unit to swing in the forward/backward direction.

7. The rocking type exercising apparatus of claim 3, wherein the pitch driving part causes the front end of the movable unit to swing in the forward/backward direction and an upward/downward direction, and causes the rear end of the movable unit to swing in the forward/backward direction.

8. The rocking type exercising apparatus of claim 4, wherein the pitch driving part causes the front end of the movable unit to swing in the forward/backward direction and an upward/downward direction, and causes the rear end of the movable unit to swing in the forward/backward direction.

9. The rocking type exercising apparatus of claim 5, wherein the pitch driving part causes the front end of the movable unit to swing in the forward/backward direction and an upward/downward direction, and causes the rear end of the movable unit to swing in the forward/backward direction.

10. The rocking type exercising apparatus of claim 1, wherein a movement of the center point in the forward/backward direction is along a path in the forward direction that is displaced from a path of the center point in the backward direction.

11. The rocking type exercising apparatus of claim 1, wherein the center point of the movable unit moves along a closed loop path.

* * * * *